United States Patent [19]

Reyes

[11] 3,943,581

[45] Mar. 16, 1976

[54] COMBINATION SINK ENCLOSURE AND SHELF ASSEMBLY

[75] Inventor: Gil Reyes, San Francisco, Calif.

[73] Assignee: Lawrence Peska Associates, Inc., New York, N.Y. ; a part interest

[22] Filed: Apr. 24, 1975

[21] Appl. No.: 571,485

[52] U.S. Cl. ..... 4/187 R; 312/228

[51] Int. Cl.[2] ..... E03C 1/18

[58] Field of Search ..... 312/228; 4/166, 187 R, 4/187 A

[56] References Cited

UNITED STATES PATENTS

| | | | |
|---|---|---|---|
| 371,084 | 10/1887 | Mann | 4/166 |
| 594,086 | 11/1897 | Irish | 4/166 |
| 1,724,479 | 8/1929 | Hauener | 312/228 |
| 2,009,225 | 7/1935 | Farrar | 4/187 R |
| 2,080,573 | 5/1937 | Madsen | 4/187 R |
| 2,175,329 | 10/1939 | Watt | 4/166 |
| 2,515,099 | 7/1950 | Smith | 312/228 |

*Primary Examiner*—Robert I. Smith

[57] ABSTRACT

The present invention pertains to a combined sink enclosure and shelf assembly comprising a substantially inverted frustotrapezoidal housing preferably formed of an ornamental aluminum mesh material, said housing having a plurality of horizontally disposed substantially U-shaped shelves secured therearound, with the shelves disposed in vertically offset relationship. The rear of the housing is provided with an inwardly disposed flange which is adapted to be secured to the wall of a lavatory, such as by gluing. The upper peripheral portion of the housing is provided with clips or other securement means for securing said upper peripheral housing portion to the inner surface of the sink base in conformed engagement therewith.

10 Claims, 3 Drawing Figures

FIG. 1
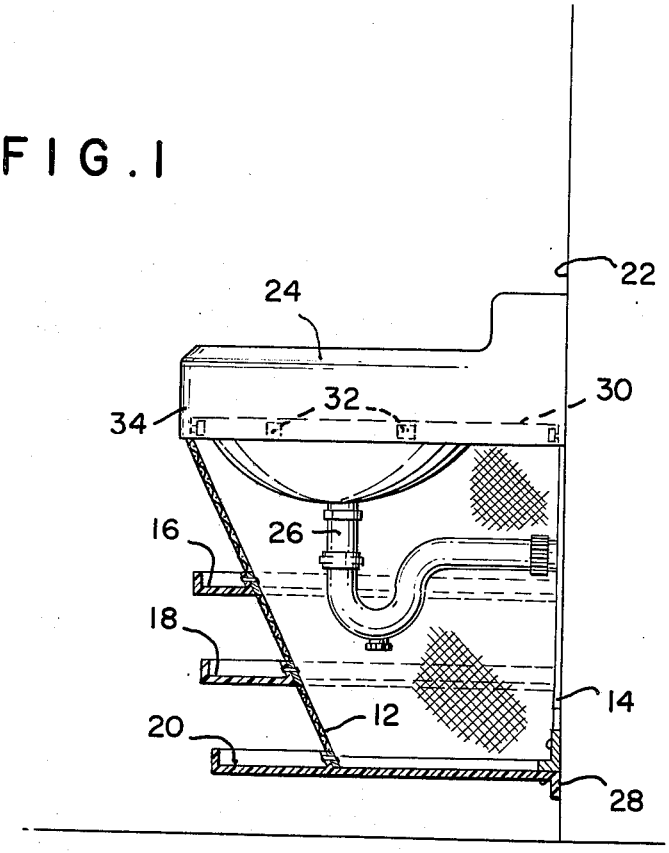
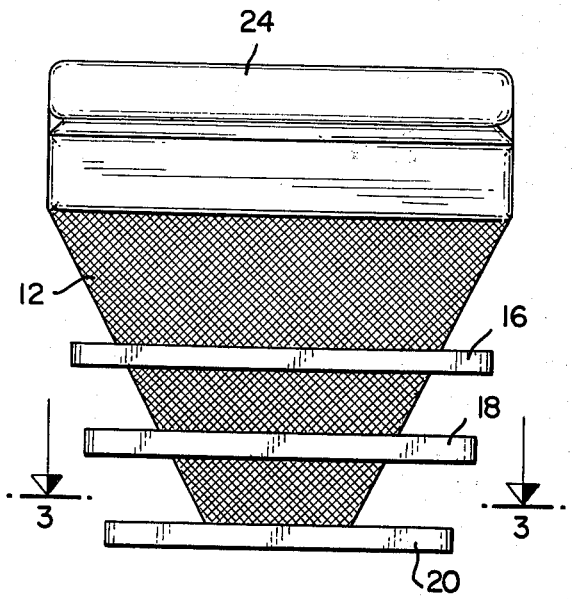
FIG. 2
FIG. 3
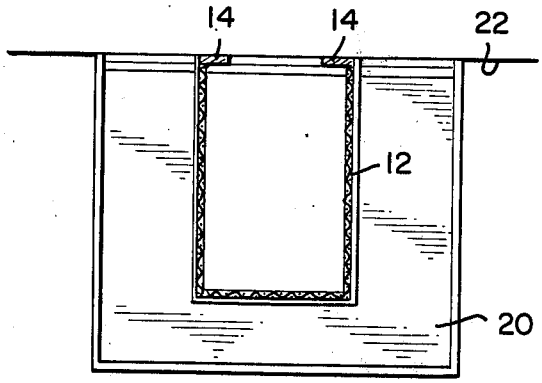

COMBINATION SINK ENCLOSURE AND SHELF ASSEMBLY

BACKGROUND OF THE INVENTION

The present invention pertains to a new and novel combination sink enclosure and shelf assembly for enclosing the unsightly pipes in a lavatory and simultaneously therewith providing a plurality of vertically spaced shelves for storing various bathroom sundries.

Accordingly, it is the principle object of the present invention to provide a new and novel sink enclosure and shelf assembly which is decorative in nature and which includes a plurality of storage shelves.

It is another object of the present invention to provide a combination sink enclosure and shelf assembly of the aforedescribed type having a frustotrapezoidal housing fabricated of an aluminum mesh material.

It is another object of the present invention to provide a combination sink enclosure and shelf assembly as aforesaid, provided with a plurality of horizontally disposed vertically spaced shelves secured to said frustotrapezoidal housing and which shelves are formed of a clearplastic type material for both aesthetic appearance and structural rigidity.

BRIEF DESCRIPTION OF THE DRAWINGS

The foregoing and other features, objects and advantages of the present invention will become more apparent from the detailed description hereinafter considered in conjunction with the accompanying drawings, wherein:

FIG. 1 is a side elevational view of the combination sink enclosure and shelf assembly of the present invention;

FIG. 2 is a front view of the combination sink enclosure and shelf assembly depicted in FIG. 1; and FIG. 3 is a view taken on the line 3—3 of FIG. 2.

DETAILED DESCRIPTION OF THE PREFERRED EMBODIMENTS

Referring now to the drawings and more particularly to FIG. 1 thereof, there is shown a combination sink enclosure and shelf assembly, generally denoted by the reference numeral 10 and constructed in accordance with the principles of the present invention.

The assembly 10 comprises an inverted frustotrapezoidal housing 12, having a pair of vertically disposed flanges 14. The assembly 10 also includes a plurality of horizontally oriented shelves 16, 18 and 20 disposed in vertically spaced relationship. The shelves 16, 18 and 20 may be glued or secured to the housing 12, by gluing, clipping or by any other suitable securement means.

The assembly 10 may be secured to the wall 22 of a lavatory having a wash basin or sink 24 secured on said wall. The manner or securement of the assembly 10 may be by gluing the flanges 14 to the wall 22. However, if this type of securement means is employed, it may be difficult to remove the assembly 10 when it is necessary to gain access to the plumbing pipes 26, as seen in FIG. 1. Thus, a preferred manner of securement of the assembly 10 to the wall 22 is by providing mounting clips on the flanges 14 which may directly engage the wall 22 or which may be engageable with complimentary members secured to the wall 22, in a manner well known to those skilled in the art. In this regard, attention is directed to the fact that although the flanges 14 are herein illustrated as being inwardly disposed with respect to the housing 12, it is contemplated that they may be externally disposed with respect to said housing.

The housing 12 also includes a horizontally disposed lower projection 28 which may be used for securing the housing 12 to the wall 22, in the same manner described hereinabove in conjunction with the flanges 14, and the flanges 14 may merely be disposed in abutting engagement with the wall 22 or may be omitted from the housing 12 entirely.

The housing 12 also includes an upper peripheral portion denoted by the reference numeral 30, which may be provided with frictional engaging clips or pads 32 so as to enable said upper peripheral portion 30 to be fixedly positionable within the interior of the lower portion 34 of the sink 24. In this regard, the upper peripheral portion 30 will then be disposed in peripheral conformal engagement with the interior peripheral surface of the sink lower portion 34, as best seen in FIG. 1.

As discussed hereinabove, the shelves 16, 18 and 20 may be secured to the housing 12 by being glued or clipped to said housing. The housing 12 is preferably fabricated of an aluminum mesh material which may exhibit a silver color or which may be anodized to give a brass appearance. The shelves 16, 18 and 20 are preferably fabricated of a clear acrylic plastic material. It will be apparent from an inspection of FIG. 2 that the shelf space for placement of toilet articles and other sundries is greater with regard to shelf 20 than it with regard to shelf 16, thereby providing space for both large and small articles.

From the foregoing discussion, it will be apparent that the combination sink enclosure and shelf assembly of the present invention provides a compact and highly decorative structure for enclosing the unsightly pipes associated with a sink and concomitantly therewith, provides for storage of toiletries.

It will also be apparent to those skilled in the art that the detachable clipping arrangement of the assembly 10 to the wall 22 and the sink lower portion 34 permits easy removal of the assembly 10 when it is necessary to gain access to the pipes 26.

While I have shown and described the various embodiments of my invention, various modifications, changes and improvements may be made by those skilled in the art without departing from the spirit and scope of the present invention.

What is claimed is:

1. A combination sink enclosure and shelf assembly for use in a lavatory arrangement including a wall and a sink affixed to said wall, said assembly comprising a substantially inverted frustotrapezoidal housing, a plurality of shelves, means for securing said shelves to said housing in vertically spaced and horizontally disposed relationship, and means for securing said housing to said wall in proximal relationship beneath said sink.

2. A combination sink enclosure and shelf assembly in accordance with claim 1, wherein said shelves have a substantially U-shaped configuration.

3. A combination sink enclosure and shelf assembly in accordance with claim 1, wherein said housing includes a rear portion comprising a pair of flanges, and fastening means for securing said flanges to said wall to thereby secure said housing with respect to said wall.

4. A combination sink enclosure and shelf assembly in accordance with claim 3, wherein said fastening means are detachably securable to permit easy attachment of and detachment of said housing to said wall.

5. A combination sink enclosure and shelf assembly in accordance with claim 1, wherein said housing includes an upper peripheral portion, and said upper peripheral portion is disposed in conformal abutting engagement with the lower interior portion of said sink.

6. A combination sink enclosure and shelf assembly in accordance with claim 5, including means for detachably securing said upper peripheral portion with respect to said sink lower portion.

7. A combination sink enclosure and shelf assembly in accordance with claim 4, wherein said housing includes an upper peripheral portion, and said upper peripheral portion is disposed in conformal abutting engagement with the lower interior portion of said sink.

8. A combination sink enclosure and shelf assembly in accordance with claim 7, including means for detachably securing said upper peripheral portion with respect to said sink lower portion.

9. A combination sink enclosure and shelf assembly in accordance with claim 8, wherein said housing is fabricated of an aluminum mesh material.

10. A combination sink enclosure and shelf assembly in accordance with claim 7, wherein said shelves have a substantially U-shaped configuration, and the outer edges of said shelves are disposed in vertically coplanar relationship.

* * * * *